US006741713B1

(12) United States Patent
Boone et al.

(10) Patent No.: US 6,741,713 B1
(45) Date of Patent: May 25, 2004

(54) DIRECTIONAL HEARING DEVICE

(75) Inventors: M. M. Boone, Zoetermeer (NL); I. L. D. M. Merks, Delft (NL); A. Z. van Halteren, Hobrede (NL)

(73) Assignee: Sonionmicrotronic Nederlan B.V. (NL)

( * ) Notice: Subject to any disclaimer, the term of this patent is extended or adjusted under 35 U.S.C. 154(b) by 0 days.

(21) Appl. No.: 09/213,468

(22) Filed: Dec. 17, 1998

(51) Int. Cl.[7] ..... H04R 25/00

(52) U.S. Cl. ..... 381/313; 381/327; 381/381; 381/313; 381/26; 367/119; 367/121

(58) Field of Search ..... 381/92, 313, 26, 381/327, 381; 367/119, 121; 352/11, 34

(56) References Cited

U.S. PATENT DOCUMENTS

| | | | | |
|---|---|---|---|---|
| 4,291,203 A | * | 9/1981 | Bellafiore | |
| 4,334,740 A | | 6/1982 | Wray | 352/11 |
| 4,773,095 A | | 9/1988 | Zwicker et al. | 381/68.1 |
| 4,956,867 A | * | 9/1990 | Zurek et al. | |

FOREIGN PATENT DOCUMENTS

| | | |
|---|---|---|
| DE | 44 36 272 A1 | 4/1996 |
| EP | 0 430 513 A2 | 6/1991 |
| EP | 0 652 686 A1 | 5/1995 |
| WO | WO/95/12961 | 5/1995 |

* cited by examiner

*Primary Examiner*—Curtis Kuntz
*Assistant Examiner*—Dionne Harvey
(74) *Attorney, Agent, or Firm*—Michaelson & Associates; Peter L. Michaelson

(57) ABSTRACT

A hearing device comprising at least two microphones, a processor and an output for further processing in a reproducer, the microphones being electrically coupled to the processor, and the output for further processing in a reproducer being connected to the processor. The processor comprises: a summer providing a sum signal of the microphone signals, and to which summer a proportional amplifier is connected, and a summer for providing a difference signal of the microphone signals, to which summer an integrator is connected, and that the proportional amplifier and the integrator are coupled on the output side to a third summer providing a sum signal of the proportional amplifier and the integrator, and that the third summer forms the output for further processing in a reproducer.

4 Claims, 3 Drawing Sheets

Frequency Response

Directivity Index

DIRECTIONAL HEARING DEVICE

BACKGROUND OF THE INVENTION

1. Field of the Invention

The invention relates to a hearing device comprising at least two microphones, a processor and an output for further processing in a reproducer, the microphones being electrically coupled to the processor which comprises a first summer for providing a difference signal of the microphone signals, to which first summer an integrator is connected, and the output for further processing in a reproducer being connected to the processor.

2. Description of the Prior Art

Such a hearing apparatus is known from the international patent application WO 95/12961. This application relates to a directional microphone system in which three microphones are used. Of two microphones, the output signals are amplified both proportionally and integratingly and supplied to a summer.

In hearing apparatus, the directivity is very important to achieve a high audibility of speech. The acoustic signals should be selectively amplified: only the speech signals or other important audio information should be amplified, not the inevitable undesired noise.

SUMMARY OF THE INVENTION

There is therefore a need for highly directional hearing apparatus in which the directional characteristic of the hearing apparatus gives a good response to the difference in sound pressure between two discrete microphones.

The invention provides such a hearing apparatus, which is characterized in that the processor comprises a second summer providing a sum signal of the microphone signals, and to which second summer a proportional amplifier is connected, and that the proportional amplifier and the integrator are coupled on the output side to a third summer providing a sum signal of the proportional amplifier and the integrator, and that the third summer forms the output for further processing in a reproducer.

Thus, a flat frequency response and a nearly constant directional index can be achieved.

The invention can advantageously be used such that the hearing device comprises three microphones and two processors, of which microphones in each case two are connected pairwise to a processor, that a first processor is connected to a low-pass filter, that a second processor is connected to a high-pass filter, that the low-pass filter and the high-pass filter are connected to a fourth summer for providing a sum signal of the low-pass filter and the high-pass filter, and that the fourth summer forms the output for further processing in a reproducer.

BRIEF DESCRIPTION OF THE DRAWINGS

The invention will now be explained below in more detail, with reference to the accompanying drawings and the description, by way of example, in which drawings.

DETAILED DESCRIPTION

Figure 1:
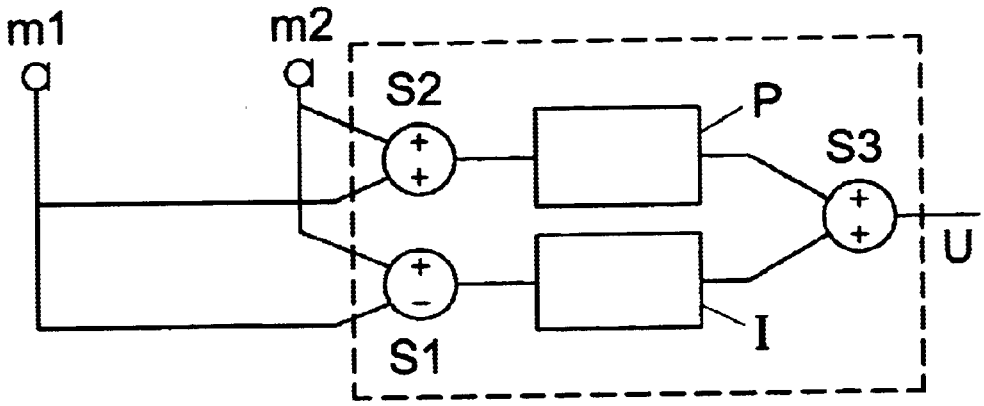
FIG. 1 schematically shows the diagram of the invention.

Referring to FIG. 1 two microphones $m_1$ and $m_2$ are schematically shown, which form part of a hearing device according to the invention. The microphones $m_1$ and $m_2$ are, for instance, omnidirectional microphones spaced apart a given distance. The processor is schematically indicated by dash lines.

The microphones $m_1$ and $m_2$ are electrically coupled in any suitable manner to a first summer S1 for providing a difference signal of these microphone signals. Furthermore, an integrator I is connected to this first summer S1. As is known to those skilled in the art, an integrator can be composed using analog electronics. The microphones $m_1$ and $m_2$ are also electrically coupled in any suitable manner to a second summer S2 for providing a sum signal of these microphone signals. A proportional amplifier P is connected to this second summer.

Both the integrator I and the proportional amplifier P have their outputs coupled to a third summer S3 which provides a sum signal of the signal from the proportional amplifier P and the signal from the integrator I. The sum signal from the third summer S3 forms the output U for further processing in a reproducer (not shown).

The output signal is the input signal for the reproducer.

The operation of such a hearing device is based on the principle of the first order gradient receiver. This principle is known per se to those skilled in the art and will therefore not be described in detail.

Suffice it to observe that the gradient is obtained by processing the signals from the separate omnidirectional microphones.

In practice, the hearing device shown in FIG. 1 is adapted for a specific frequency range.

Figure 2:
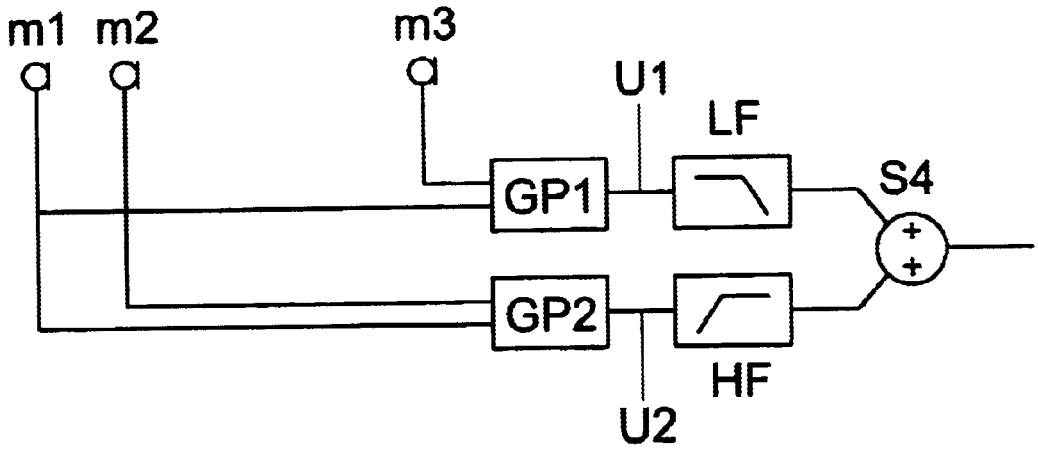
FIG. 2 schematically shows the diagram of an advantageous embodiment of the invention.

FIG. 2 shows three omnidirectional microphones $m_1$, $m_2$ and $m_3$ for a hearing device and two processors GP1 and GP2 with output signals $U_1$ and $U_2$, respectively. The distance between $m_1$ and $m_2$ is different from the distance between $m_1$ and A. Of these microphones, in each case two are connected pairwise to a first and a second processor, GP1 indicating a low-frequency gradient processor and GP2 a high-frequency gradient processor, respectively.

Each of these processors is designed in the same manner as the processor shown in FIG. 1.

A low-pass filter LF is connected to the processor GP1, while a high-pass filter HF is connected to the processor GP2.

Furthermore, the low-pass filter LF and the high-pass filter HF are connected to a fourth summer S4 which can provide a sum signal of LF and HF. The output of the summer S4 feeds the reproducer (not shown).

The cross-over frequency of the high-pass filter and the low-pass filter can be optimized such that the output has a flat frequency response.

Figure 3A:
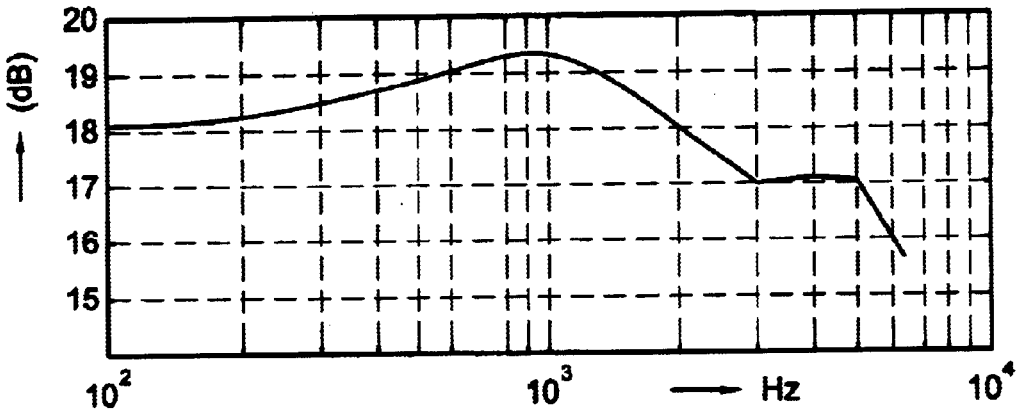
FIGS. 3*a* and 3*b* show graphs of the frequency response vs. frequency and directional index vs. frequency, plotting results of a hearing device according to the invention.
Figure 3B:
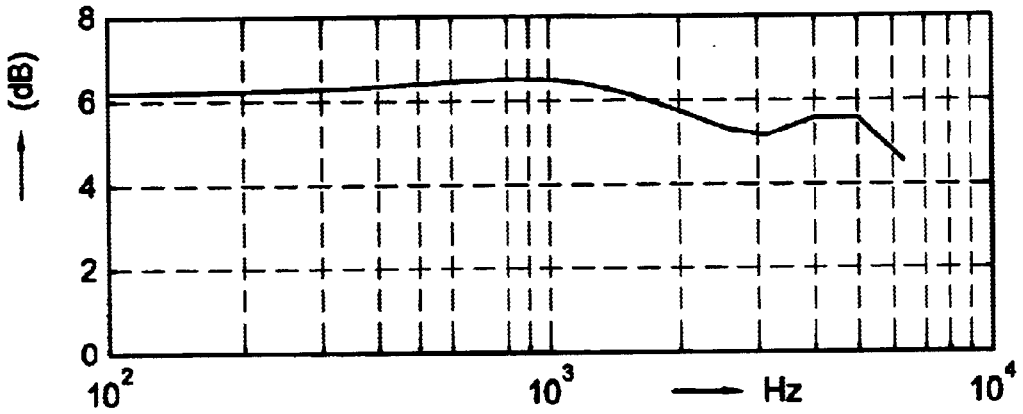

FIGS. 3*a* and 3*b* show graphs of results of an advantageous embodiment according to the invention. The microphone distances were 0.1 m for the low-frequency microphone pair and 0.016 m for the high-frequency microphone pair. The graduations are logarithmic.

In FIG. 3*a* the horizontal axis indicates the frequency in Hz, while the vertical axis shows the frequency response in dB.

In FIG. 3*b* the horizontal axis indicates the frequency in Hz, while the vertical axis shows the directivity index in dB.

The directivity index is a measure, generally accepted by skilled persons, of the directional behavior of a microphone or microphone arrangement.

The graphs show that between 100 Hz and 5000 Hz the frequency response is flat and the directivity index is nearly constant.

It is observed that a flat frequency response can be undesirable in some applications of hearing devices, because, e.g., amplification is only necessary at higher frequencies. In that case high-pass filters can be used immediately after the microphones or at the output of the circuit.

Figure 4:
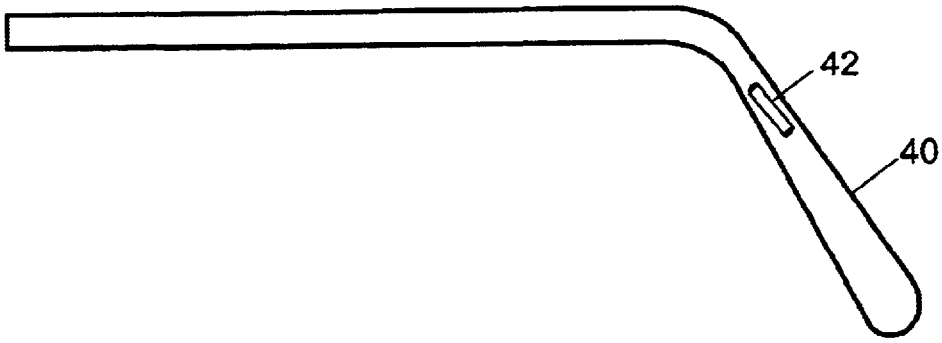
FIG. 4 shows a side piece of an eyeglass to which the embodiment of the invention is mounted.
Figure 5:
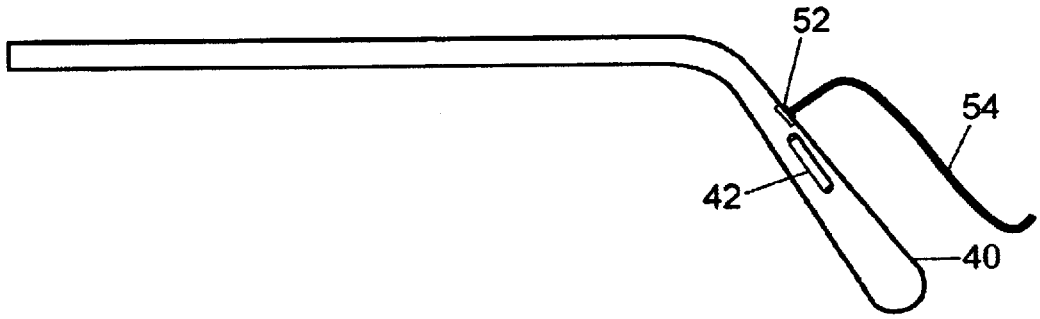
FIG. 5 shows an eyeglass side piece, in the same fashion as does FIG. 4, to which the embodiment of the invention is mounted but where an output signal from the embodiment is routed, via a plug connection, to an external reproducer.

As shown in FIG. 4, the hearing device 42 according to the invention may advantageously be accommodated in or on a side piece 40 of eyeglasses. The electric power may then be supplied by, e.g., a battery or solar cell. Alternatively, with respect to FIG. 5 and with device 42 mounted on (as shown) or in eyeglass side piece 40, the he electrical output signal may be fed to the reproducer via a plug contact 52 or a coil generating an electromagnetic field which can be received by a listening coil in the hearing apparatus.

What is claimed is:

1. A hearing device having three microphones ($m_1$, $m_2$, $m_3$), all of the microphones collectively providing microphone signals, and two processors, wherein the microphones are electrically coupled on a pair-wise basis ($m_1$, $m_3$; $m_1$, $m_2$) to the first and second processors, each of the first and second processors comprising:

a first summer for providing a difference signal of two of the microphone signals applied to said each processor;

an integrator connected to an output of the first summer;

an output, for further processing in a reproducer, being connected to the processor so as to define a processor output;

a second summer for providing a sum signal of said two of the microphone signals;

a proportional amplifier connected to an output of the second summer; and a third summer coupled to outputs of the proportional amplifier and the integrator and providing a sum signal of the output signals of the proportional amplifier and the integrator, an output of the third summer forming the processor output; and wherein:

the output of the third summer of the first processor is connected to an input of a low-pass filter;

the output of the third summer of the second processor is connected to the input of a high-pass filter;

outputs of the low-pass filter and the high-pass filter are connected to corresponding inputs of a fourth summer for providing at an output thereof a sum signal of the output signals of the low-pass filter and the high-pass filter and an output of the fourth summer forming a device output signal for further processing in a reproducer.

2. The hearing device according to claim 1 wherein the device is accommodated in or on a side piece of eyeglasses.

3. The hearing device according to claim 1 wherein the device output signal is fed to the reproducer via a plug contact or a coil.

4. The hearing device according to claim 2 wherein the device output signal is fed to the reproducer via a plug contact or a coil.

* * * * *